US012696948B2

(12) United States Patent
Brouwer et al.

(10) Patent No.: US 12,696,948 B2
(45) Date of Patent: Aug. 4, 2026

(54) HEAD PROTECTION DEVICE WITH HOLDING UNIT AND PROTECTION UNIT

(71) Applicant: Optrel Holding AG, Wattwil (CH)

(72) Inventors: Jasper Brouwer, Stäfa (CH); Jonathan Heusser, Uerikon (CH)

(73) Assignee: Optrel Holding AG, Wattwil (CH)

( * ) Notice: Subject to any disclaimer, the term of this patent is extended or adjusted under 35 U.S.C. 154(b) by 0 days.

(21) Appl. No.: 18/079,880

(22) Filed: Dec. 13, 2022

(65) Prior Publication Data

US 2023/0180877 A1 Jun. 15, 2023

(51) Int. Cl.

| | |
|---|---|
| ***A42B 3/08*** | (2006.01) |
| ***A42B 3/22*** | (2006.01) |
| ***A42B 3/28*** | (2006.01) |

(52) U.S. Cl.

CPC ..... *A42B 3/08* (2013.01); *A42B 3/221* (2013.01); *A42B 3/281* (2013.01)

(58) Field of Classification Search

CPC .. A61F 9/06; A42B 3/08; A42B 3/085; A42B 3/14

See application file for complete search history.

(56) References Cited

U.S. PATENT DOCUMENTS

| | | | | |
|---|---|---|---|---|
| 4,117,554 | A * | 10/1978 | Palumbo | A61F 9/06 2/418 |
| 5,673,431 | A | 10/1997 | Batty | |
| 6,151,718 | A | 11/2000 | Shirai | |
| 9,526,288 | B2 * | 12/2016 | Pfanner | A42B 3/145 |
| 9,814,622 | B2 * | 11/2017 | Sommers | A61F 9/06 |
| 10,588,373 | B2 * | 3/2020 | Staudinger | A42B 3/08 |
| 11,213,089 | B2 * | 1/2022 | Bohn | A42B 3/225 |
| 2014/0298557 | A1 | 10/2014 | Townsend, Jr. et al. | |
| 2016/0081856 | A1 | 3/2016 | Hofer-Kraner et al. | |
| 2016/0361201 | A1 | 12/2016 | Sommers | |
| 2018/0184746 | A1 * | 7/2018 | Plebani | A42B 3/225 |

FOREIGN PATENT DOCUMENTS

| | | | | |
|---|---|---|---|---|
| GB | 2098459 A | * | 11/1982 | A42B 3/14 |

OTHER PUBLICATIONS

Extended European Search Report on the Patentability of Application No. 21214144.4, Mailed May 31, 2022, 11 pages.

Office Action received in related European Application No. 21214144.4, mailed Feb. 6, 2025, 8 pages.

* cited by examiner

*Primary Examiner* — Katherine M Moran

(74) *Attorney, Agent, or Firm* — Womble Bond Dickinson (US) LLP

(57) ABSTRACT

A protection device comprises a head-fastening unit for fastening to a user's head and comprises a holding unit that is configured for connecting at least one protection unit to the head-fastening unit for the user's protection, wherein the holding unit is configured for connecting at least one further protection unit to the head-fastening unit.

18 Claims, 8 Drawing Sheets

HEAD PROTECTION DEVICE WITH HOLDING UNIT AND PROTECTION UNIT

CROSS-REFERENCE TO RELATED APPLICATION

Figure 1:
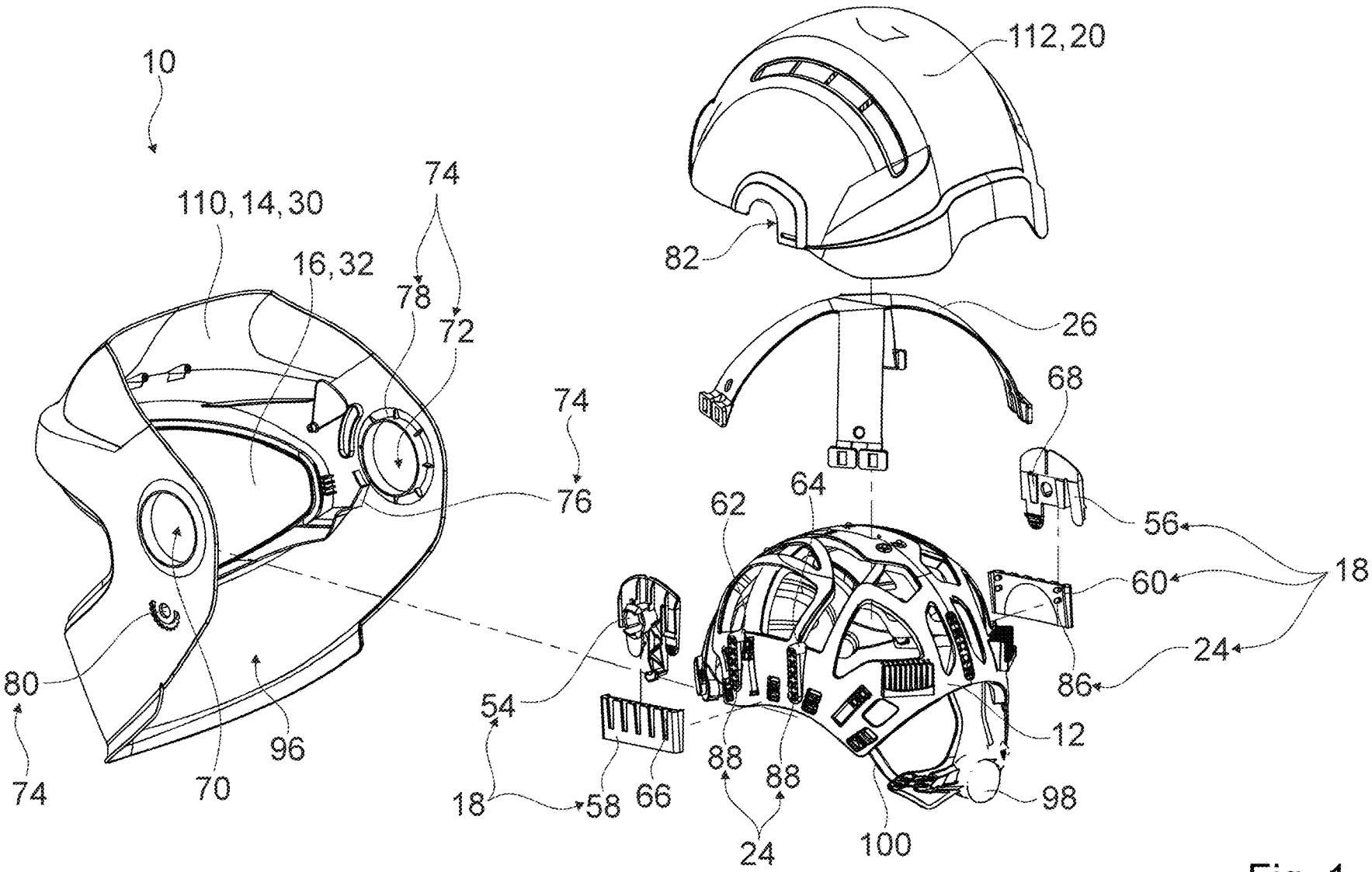

This application is based on and incorporates herein the European patent application EP 21214144.4 filed on Dec. 13, 2021.

PRIOR ART

The invention concerns a protection device.

Protection devices with a head-fastening unit for a fastening to a user's head are already known from the prior art. On the one hand, protection devices are known with protection units which are embodied as protective visors, for example welding protection visors, with a headband for fastening to a user's head. On the other hand, protection devices are known with protection units which are embodied as protective helmets, for example construction workers' helmets. Up to now, there is a disadvantage for a user in that—depending on a type of work to be done—either a protection device must be worn which is embodied as a protective visor or a protection device which is embodied as a protective helmet, these two types of protection device being, if at all, rather difficult to combine with each other, for example as a brim of a protective helmet makes correct wearing of a protective visor impossible. Therefore, flexibility is very limited, which is a disadvantage. Another disadvantage lies in that, due to reduced motivation for complying with work safety regulations with regard to the wearing of different protection devices for different types of work because of the effort involved, there is a negative impact on work safety.

The objective of the invention is in particular to provide a generic device having improved flexibility. The objective is achieved according to the invention aims.

Advantages of the Invention

The invention is based on a protection device with a head-fastening unit for fastening to a user's head and with a holding unit that is configured for connecting a protection unit to the head-fastening unit.

It is proposed that the holding unit is configured for connecting at least one further protection unit to the head-fastening unit.

Such an implementation advantageously allows providing a protection device with increased flexibility. As both the protection unit and the further protection unit, in particular individually or in combination, are connectable to the head-fastening unit via the holding unit, particularly flexible use of the protection device is advantageously enabled. It is furthermore advantageously possible to provide a protection device with improved operating comfort.

Beyond this, safety can be increased for users of the protection device. In particular, work safety for users can be increased. In particular, the particularly simple and quick connection of the protection unit and/or the further protection unit advantageously motivates users to comply with work safety regulations, for example compulsory use of helmets on construction sites and the like.

The protection device is configured for work safety, in particular on construction sites and/or in dangerous areas and/or when carrying out dangerous work, for example welding work. Preferably the protection device is realized as a multifunctional protection device and is configured for a protection when carrying out different types of dangerous work.

By a "head-fastening unit" is a unit to be understood which is configured for a fastening, in particular a fixing, of the protection device to the user's head. Preferably the head-fastening unit is configured to at least partially engage around the user's head. In this context, "at least partially engage around" is to mean that a head is encompassed by the head-fastening unit in at least one plane in an angle range of at least 160°, preferably at least 180°, preferentially at least 2700 and particularly preferentially at least 360°. Particularly preferentially the head-fastening unit is in a regular operation state configured to adjoin at least a forehead as well as an occiput of a user. Preferably the head-fastening unit comprises at least one tensioning element, by means of which a circumference of the head-fastening unit is adjustable, in particular for different users, and the head-fastening unit can be fixed to a respective user's head. Preferably the head-fastening unit comprises a sweatband.

The holding unit is configured for, in particular releasably, connecting the protection unit and/or the further protection unit to the head-fastening unit. The protection device may be configured—with the connection between the head-fastening unit and the protection unit established—to be used by a user without the further protection unit. In the same way, the protection device may be configured—with the connection between the head-fastening unit and the further protection unit established—to be used by a user without the protection unit. Moreover, the protection unit is configured to be used by a user when the connection between the head-fastening unit and the protection unit has been established and the connection between the head-fastening unit and the further protection unit has been established at the same time. The holding unit comprises at least one fastening element, which is connected with the head-fastening unit. Preferably the holding unit comprises at least one first fastening element and at least one further first fastening element, which are arranged on a first side, for example the lefthand side, of the head-fastening unit. Preferably, the holding unit comprises at least one second fastening element and at least one further second fastening element, which are arranged on a side of the head-fastening unit, for example the righthand side of the head-fastening unit, that is situated opposite the first side. The fastening element, respectively the fastening elements, of the holding unit may be connected with the head-fastening unit releasably, for example in a form-fit and/or force-fit manner. The holding unit further comprises at least one holding element, preferably at least two holding elements. A first holding element is configured for a connection with the head-fastening unit at the first side of the head-fastening unit via the first fastening element and the further first fastening element. A second holding element is configured for a connection with the head-fastening unit at the second side of the head-fastening unit via the second fastening element and the further second fastening element. Preferably the holding elements are configured for a releasable connection with the respective fastening elements, preferentially by means of a form-fit and/or force-fit connection, for example a latch connection and/or a clamp connection and/or the like. The holding unit moreover comprises at least one receiving element, preferably at least two receiving elements. A first receiving element of the holding unit is configured for a releasable, in particular form-fit and/or force-fit, connection with the first holding element. A second receiving element of the holding unit is configured for a releasable, in particular form-fit and/or force-fit, connection with the second holding element. For a connection of the protection unit to the head-fastening unit, the first receiving element is configured to engage into a first receiving opening of the protection unit. For a connection of the protection unit to the head-fastening unit, the second receiving element is configured to engage into a second receiving opening of the protection unit that is arranged opposite the first receiving opening. When the connection to the head-fastening unit has been established, the protection unit is supported by means of the holding unit at the receiving elements of the holding unit such that it is rotatable via the receiving openings. Preferably the protection unit comprises a fixing unit, by means of which the protection unit can be fixed in at least two positions with respect to the head-fastening unit. Preferably the protection unit can be fixed by the fixing unit in a first position with respect to the head-fastening unit, wherein a main extension plane of the protection unit is oriented at least substantially perpendicularly to a main extension plane of the head-fastening unit. Preferably the protection unit can be fixed by the fixing unit in a second position with respect to the head-fastening unit, wherein the main extension plane of the protection unit is oriented at least substantially parallel to the main extension plane of the head-fastening unit. Beyond this, the protection unit may be fixable by the fixing unit in further positions, in particular in different angle situations between the first position and the second position, with respect to the head-fastening unit. By a "main extension plane" of an object is a plane to be understood which is parallel to a largest side surface of a smallest imaginary rectangular cuboid just still completely enclosing the object, and which in particular runs through the center point of the rectangular cuboid.

Preferably a horizontal distance between the protection unit and the head-fastening unit is adjustable, in particular via the holding unit. For this purpose the holding elements of the holding unit preferably have several latch recesses, which are arranged side by side horizontally and in which corresponding latch tabs of the receiving elements can be latched depending on a desired horizontal distance. This advantageously enables an adjustment of a distance between the protection unit and the face of the user of the protection device. In this way it is possible to switch between an arrangement for spectacle wearers and an arrangement for users without spectacles. Thus users without spectacles may obtain an optimum field of vision while spectacle wearers are provided with advantageous wearing comfort.

By a "protection unit" is a unit to be understood which is configured, in a state when connected with the head-fastening unit, to provide at least one protection function for a protection of the user. The protection function may be for example, without being limited thereto, a face protection function and/or an eye protection function, for example a glare protection function, and/or a head protection function, for example for a protection against impacts and the like, and/or a respiratory protection function, for example for a protection against toxic vapors, and/or a protection function for a protection against skin contact with dangerous substances, e. g. acids and the like. Preferably the protection unit comprises at least one protection element for providing the at least one protection function. The protection unit may comprise several protection elements, in particular for providing different protection functions. The protection unit may comprise a frame element, in which the at least one protection element is accommodated and on which in particular the receiving openings for receiving the receiving element of the holding unit may be arranged. It is also possible that the protection unit is realized without a frame element. The protection element may also form the whole protection unit. For example, the protection element may be realized as a frameless visor. By a "further protection unit" is in particular a unit to be understood which is configured, in a state when connected with the head-fastening unit, to provide at least one further protection function for a protection of the user, the further protection function being different from the protection function of the protection unit. For example, the protection unit could be configured to provide a face protection function and/or eye protection function and the further protection unit could be configured to provide a head protection function.

In the present document, the term "at least substantially" is to mean that a deviation from a given value is less than 25%, preferably less than 10% and particularly preferentially less than 5% of the given value.

In the present document number words, like for example "first" and "second", which are put before certain terms merely serve for a distinction of objects and/or for a mutual allocation of objects, but do not implicate an existing total number and/or sequence of the objects. In particular, a "second object" does not necessarily imply the existence of a "first object". "Configured" is to mean specifically designed and/or equipped. By an object being configured for a certain function is to be understood that the object implements and/or executes said certain function in at least one application state and/or operation state.

The protection device may be configured—when a connection has been established between the head-fastening unit and the protection unit—to be used by a user without the further protection unit. In the same way, the protection device may be configured—when a connection has been established between the head-fastening unit and the further protection unit—to be used by a user without the protection unit. In an advantageous implementation it is further-more proposed that the holding unit is configured to connect the protection unit and the further protection unit to the head-fastening unit at the same time. Such an implementation advantageously allows further improving flexibility. In addition, with particularly dangerous work, work safety can be increased.

It is further proposed that the protection device comprises the protection unit, which is embodied as a shield unit with at least one protection element. This advantageously allows providing a protection device for an effective protection of a user's face. By a "shield unit" is a unit to be understood which is arranged in front of the user's face in a regular operational position. Preferably the shield unit is configured to cover at least a substantial portion of a user's face in the regular operational position. Preferably, in the regular operational state the shield unit is configured for a protection of a face, for example against flying sparks. Preferentially the shield unit is in particular configured to form a protective barrier between a work zone and the user's face.

Moreover it is proposed that the protection device comprises the further protection unit, which is realized as a helmet shell, in particular a construction worker's helmet shell. This advantageously allows further improving safety. In particular, effective protection of the user's head is enabled. The helmet shell is configured to receive an impact energy at least to a large extent. The term "at least to a large extent" is herein to mean at least 55%, advantageously at least 65%, preferably at least 75%, particularly preferentially at least 85% and especially advantageously at least 95%. The helmet shell is thus configured for a protection of the user's head from falling objects and/or suspended loads and/or when working in close spaces. Preferably the helmet shell is made of a synthetic material, in particular a thermoplastic synthetic material, for example polyethylene. The helmet shell may be produced, for example, by means of a plastic injection-molding process. The helmet shell may be implemented in different colors, in particular in warning colors.

Beyond this it is proposed that the helmet shell has a forehead recess. This advantageously allows improving a wearing comfort for users of the protection device. Advantageously a particularly compact helmet shell can be provided. Furthermore, simultaneous utilization of shield unit and helmet shell is enabled if the helmet shell has a forehead recess.

It is further proposed that the shield unit is configured to cover the forehead recess independently from a set position relative to the head-fastening unit. Such an implementation advantageously allows increasing safety. Preferably, in a state in which both the protection unit that is embodied as a shield unit and the further protection unit that is embodied as a helmet shell are connected with the head-fastening unit, the protection device is implemented as a complete protection helmet, in particular construction workers' helmet, which is in particular apt for certification according to the standard DIN EN 397.

Moreover, it is proposed that the holding unit comprises a height adjusting unit for an adjustment of a distance between the helmet shell and the head-fastening unit. This advantageously permits further improving a wearing comfort for users of the protection device. Advantageously a simple adjustment of the distance between the helmet shell and the head-fastening unit is possible, thus enabling an adaption of the protection device to the individual requirements of different users and/or to different application situations of the protection device.

It is also proposed that the protection device comprises a strap unit, which is arrangeable between the helmet shell and the head-fastening unit and is configured for a force transmission from the helmet shell to the user's head. This advantageously permits further improving safety. The strap unit preferably comprises two straps, which are oriented at an angle to each other, in particular perpendicularly to each other, and which are connectable at their respective ends to the helmet shell and/or to the head-fastening unit. The straps of the strap unit may be realized separately from each other and connected, for example sewed, with each other. The strap unit may be realized at least partially of a fabric and/or of leather or something like that. Preferably the straps of the strap unit are realized integrally with each other. Preferably the strap unit is made at least to a large extent, preferably completely, of a synthetic material, for example of a thermoplastic or thermoset synthetic material. Preferably the strap unit is implemented as an injection-molded component and is produced in a plastic injection-molding process. In this way simplified production and assembly are achievable.

It is further proposed that the strap unit comprises a chin strap holder. Such an implementation advantageously allows further improving flexibility and operational comfort of the protection device. The chin strap holder is configured for a releasable fastening of a chin strap at the protection device. The releasable fastening of the chin strap to the chin strap holder may be realized by a form-fit and/or force-fit connection, for example a latch connection, and/or by means of a hook-and-pile connection and/or clamp connection and/or the like. The chin strap may be part of the protection device. It is also conceivable that the chin strap is an accessory part for the protection device. By means of the chin strap, it is advantageously possible to further improve a fastening of the protection device to the user's head. Preferably the chin strap holder of the strap unit comprises at least two chin strap holder elements. In a mounted state, in which the strap unit is arranged between the helmet shell and the head-fastening unit, a first chin strap holder element of the chin strap holder is preferably arranged on a first side of the head-fastening unit and a second chin strap holder element of the chin strap holder is arranged on a second side of the head-fastening unit that is situated opposite the first side.

In addition, it is proposed that the shield unit is embodied as a welding protection visor. Such an implementation advantageously allows providing a protection device with a particularly high level of safety, in particular for a usage with welding work.

Beyond this it is proposed that the protection element of the shield unit comprises an optical glare protection filter. This advantageously allows further improving safety for users of the protection device. An "optical glare protection filter" is to mean an optical filter which forms a protection glass and/or a plastic glass. Preferably the optical glare protection filter is realized as an optical filter whose transmittance is implemented so as to be adjustable. Preferentially the optical glare protection filter is an optical welding protection filter with automatic darkening. Particularly preferentially the optical glare protection filter has a liquid-crystal plane that is switchable in the transmittance. Different implementations of the optical glare protection filter, deemed expedient by someone skilled in the art, are conceivable. The optical glare protection filter may also be realized as a so-called "automatic darkening filter" (ADF) or as an "automatic welding protection filter". Preferably the optical glare protection filter is accommodated in the shield unit fixedly, in particular in a positionally fixed manner.

It is further proposed that the protection device comprises at least one additional protection unit, which is embodied as a further shield unit and is exchangeable with the shield unit. Such an implementation advantageously allows further improving flexibility. In particular, if the protection device comprises at least one additional protection unit, which is embodied as a further shield unit and is exchangeable with the shield unit, an application range of the protection device can be extended to a great variety of fields of work, the protection device being easily and flexibly adaptable to the respective requirements.

In an advantageous implementation it is proposed that the further shield unit is embodied as a clear-view visor. This advantageously allows providing a protection device with enhanced flexibility. The further protection unit that is embodied as a clear-view visor may be configured, without being limited thereto, to provide a splash guard function, for example when working with high-pressure cleaners of the like.

In a further advantageous implementation, it is proposed that the further shield unit is embodied as a lumberjack's visor. Such an implementation advantageously allows further increasing flexibility. In particular, the further shield unit that is embodied as a lumberjack's visor advantageously enables a usage of the protection device for a protection in the context of forest work. Preferably the further protection unit that is embodied as a lumberjack's visor comprises a further protection element, which is realized as a protective mesh, for example for a protection against branches in the case of tree-cutting work or the like.

It is moreover proposed that the further shield unit comprises a further protection element, which is embodied as a sun protection element. This advantageously allows increasing flexibility even further. It is in particular possible to provide sun protection for users of the protection device. Preferably the sun protection element comprises a UV protection filter. It is also conceivable that the protection element of the shield unit is exchangeable with the further protection element of the further shield unit.

Furthermore it is proposed that the helmet shell comprises a ventilation unit with at least one ventilation opening. This advantageously allows further improving a comfort for users of the protection device. It is advantageously possible to augment wearing comfort, in particular in hot work environments, as sufficient ventilation of the user's head is enabled by the ventilation unit.

It is also proposed that the ventilation unit comprises at least one cover element, which is configured to cover the ventilation opening at least partially. Such an implementation advantageously allows increasing flexibility even further. In particular, a flexible adaption of the ventilation unit to different application situations of the protection device is facilitated. For example with welding work, in which the user's face is protected by the shield unit, an upper side of the user's head is reliably protectable against flying sparks if the ventilation opening is at least partially or completely covered by the cover element. Preferably a degree of coverage of the ventilation unit is, in particular steplessly, adjustable between a minimal and a maximal, in particular complete, coverage of the ventilation opening.

Beyond this it is proposed that the holding unit is implemented at least partially integrally with the head-fastening unit. Such an implementation advantageously enables particularly efficient production. "Integrally" is to mean connected by substance-to-substance bond, like for example by a welding process and/or a gluing process etc., and is especially advantageously to mean molded-on, e. g. by a production from a cast and/or by a production in a one-component or multi-component injection molding procedure. "At least partially integrally" is to mean that at least one element of the holding unit is implemented integrally with the head-fastening unit. Preferably the fastening element, respectively the fastening elements, of the holding unit is/are implemented integrally with the head-fastening unit. Alternatively or additionally, further elements of the holding unit, for example at least one holding element and/or at least one receiving element of the holding unit, may be implemented integrally with the head-fastening unit.

The protection device according to the invention shall herein not be limited to the application and implementation described above. In particular, in order to realize a functionality that is described here, the protection device according to the invention may comprises a number of individual elements, components and units that differs from a number given here.

DRAWINGS

Further advantages will become apparent from the following description of the drawings. In the drawings an exemplary embodiment of the invention is illustrated. The drawings, the description and the claims contain a plurality of features in combination. Someone skilled in the art will purposefully also consider the features separately and will find further expedient combinations.

Figure 2:
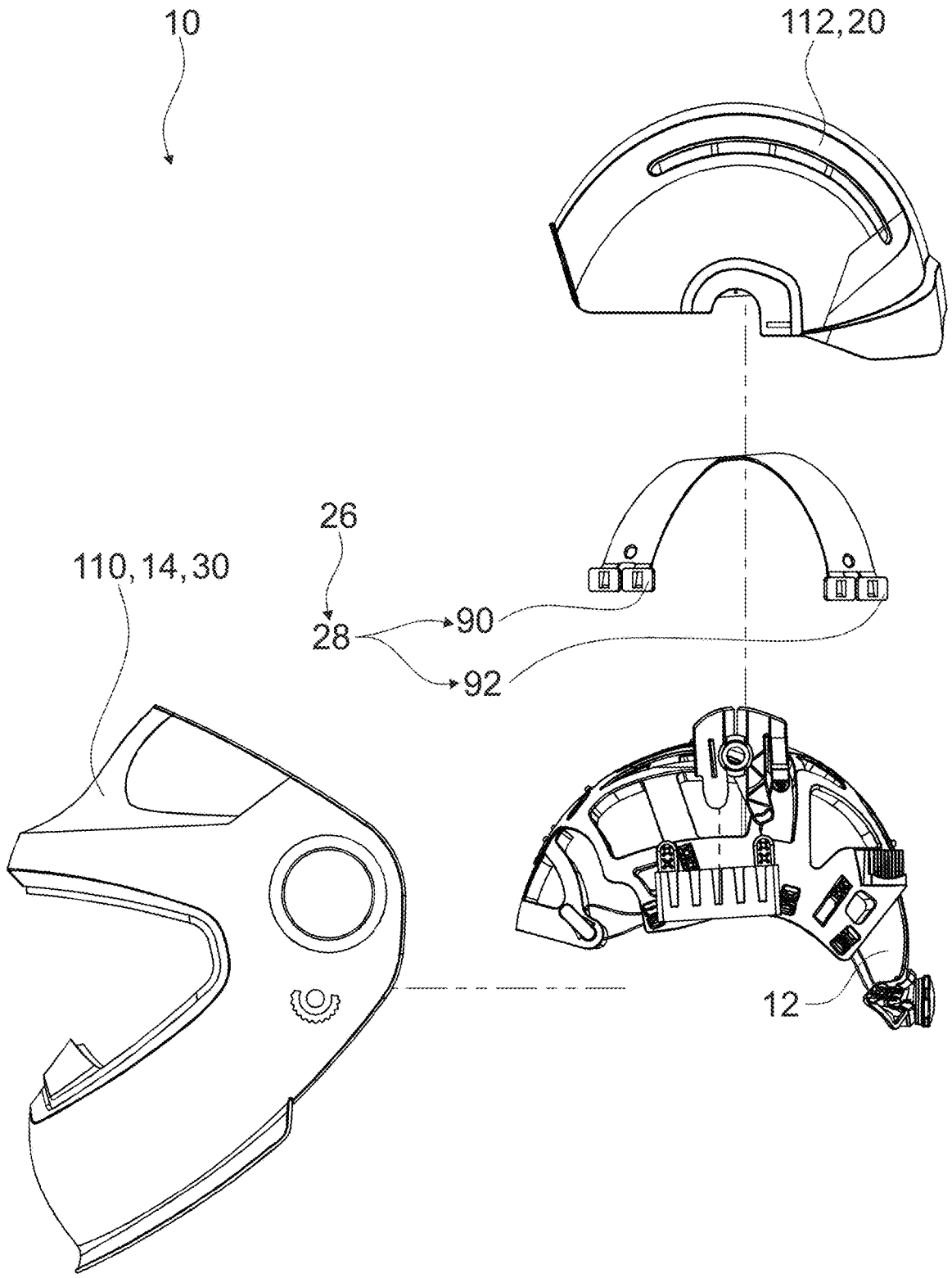
Figure 3:
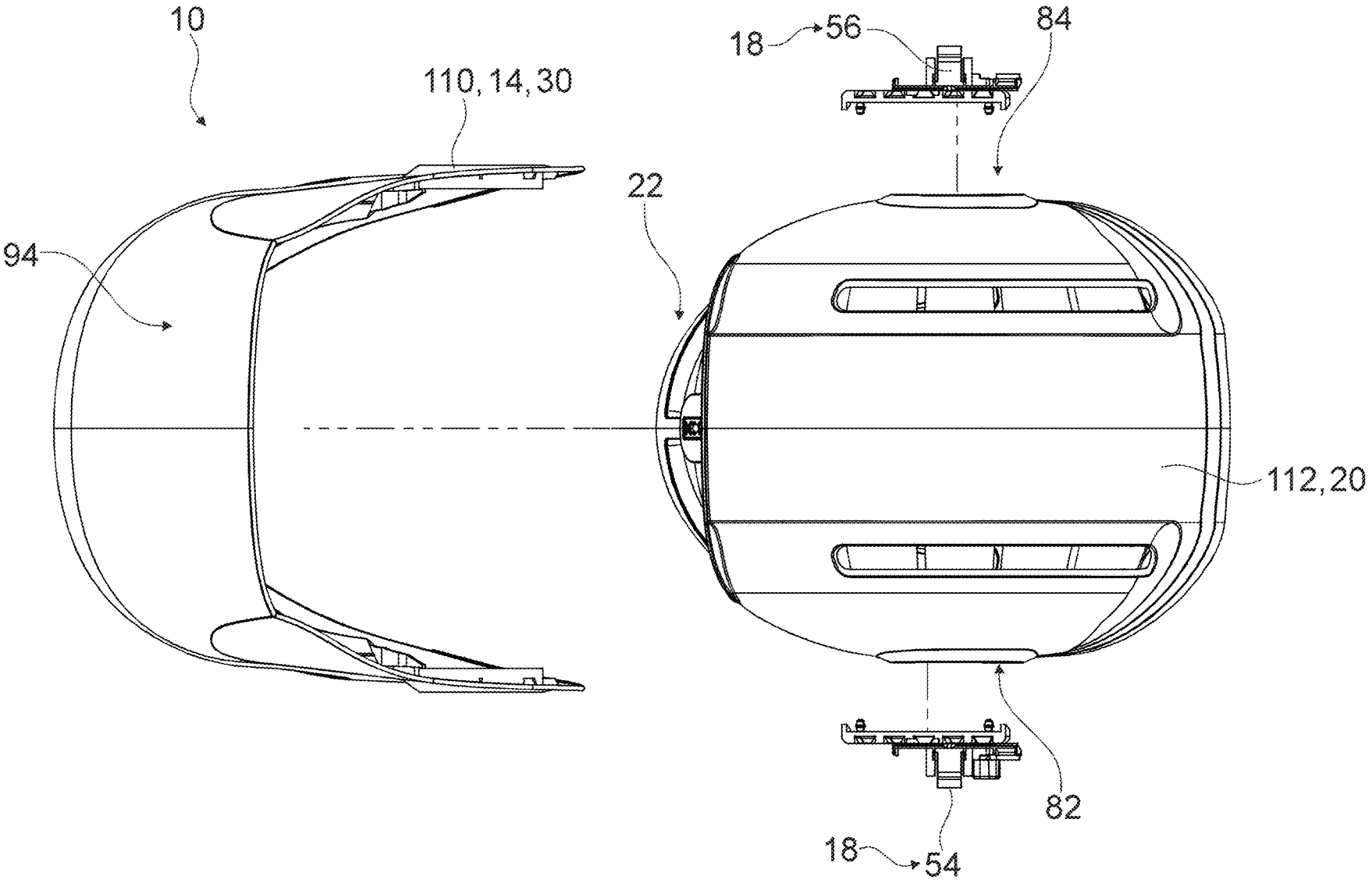
Figure 4:
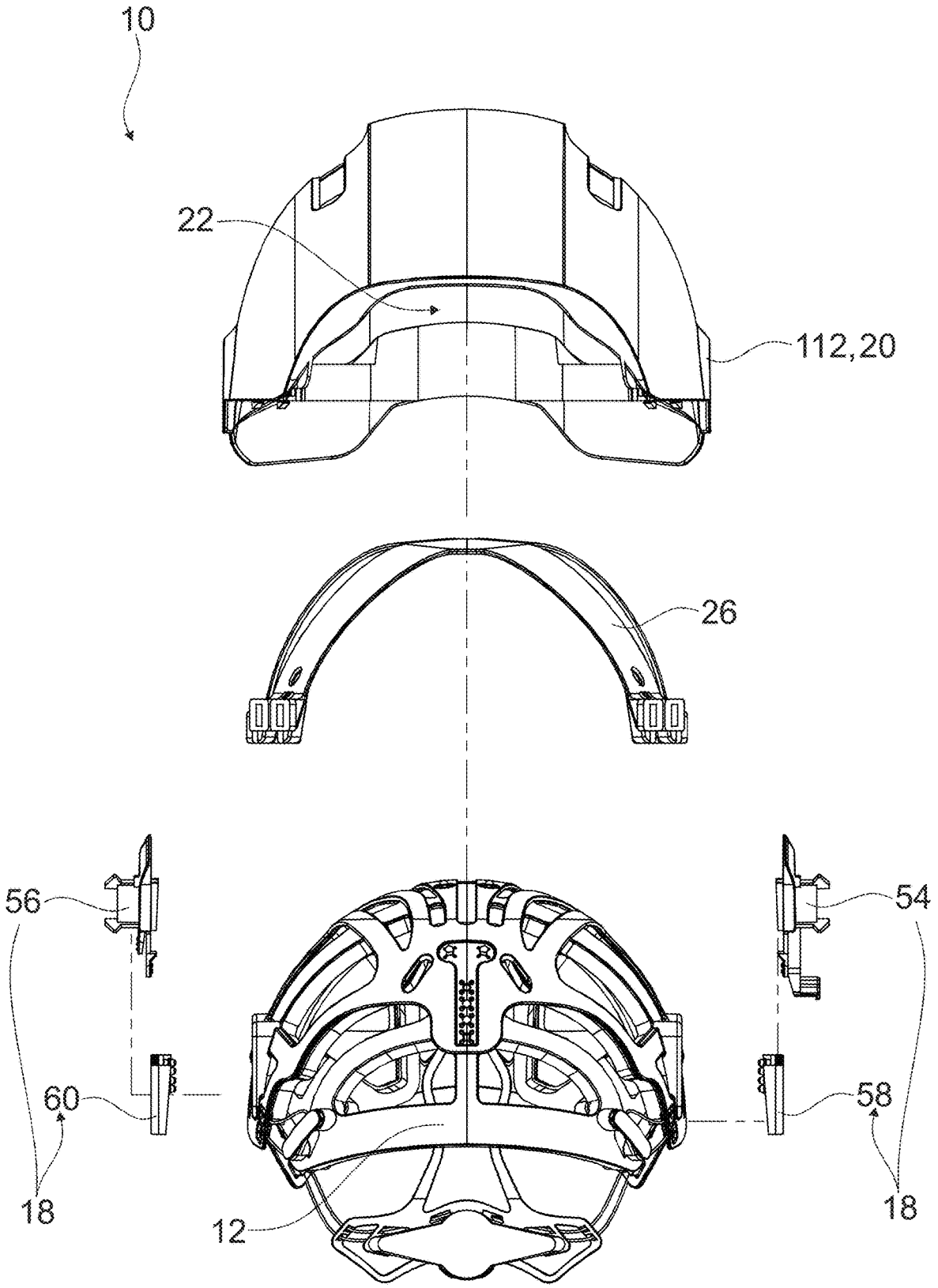
Figure 5:
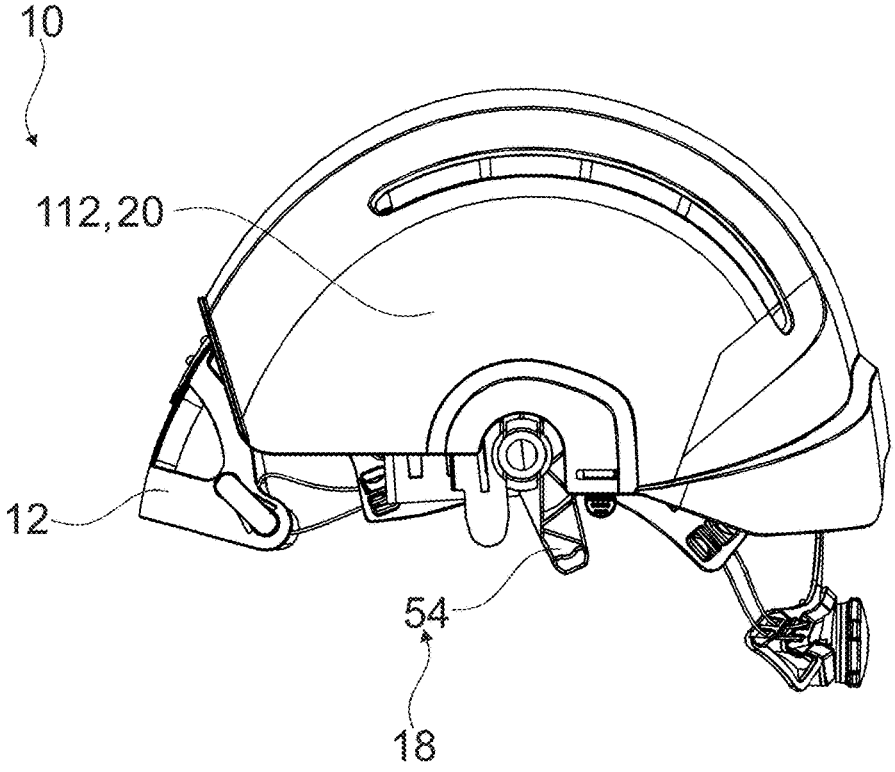
Figure 5:
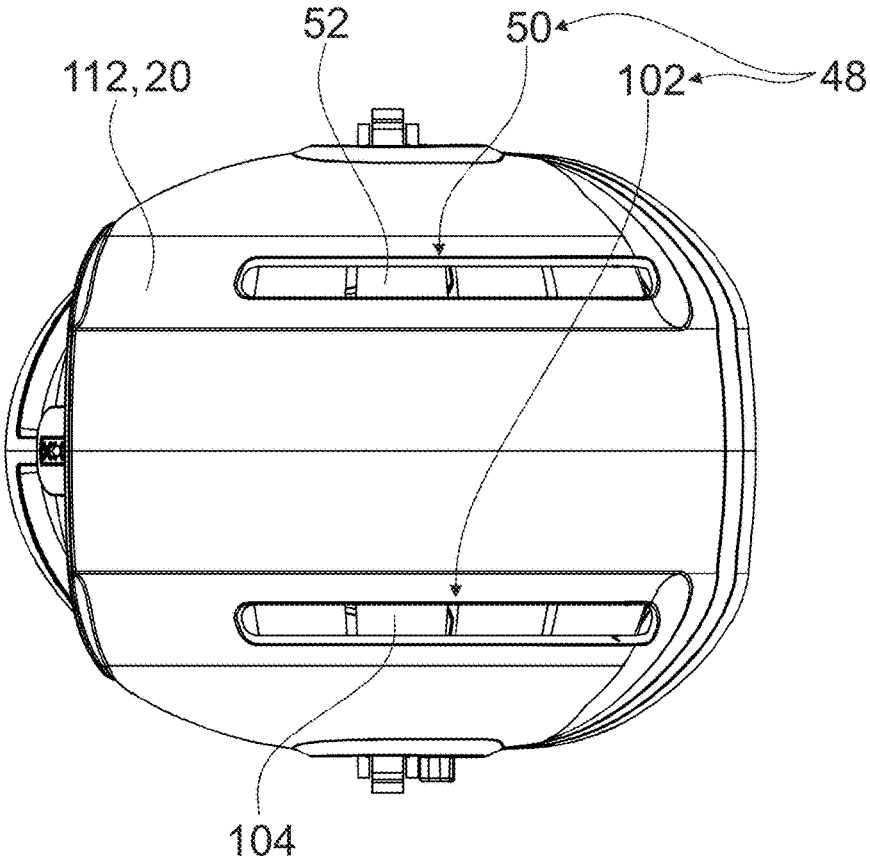
Figure 6:
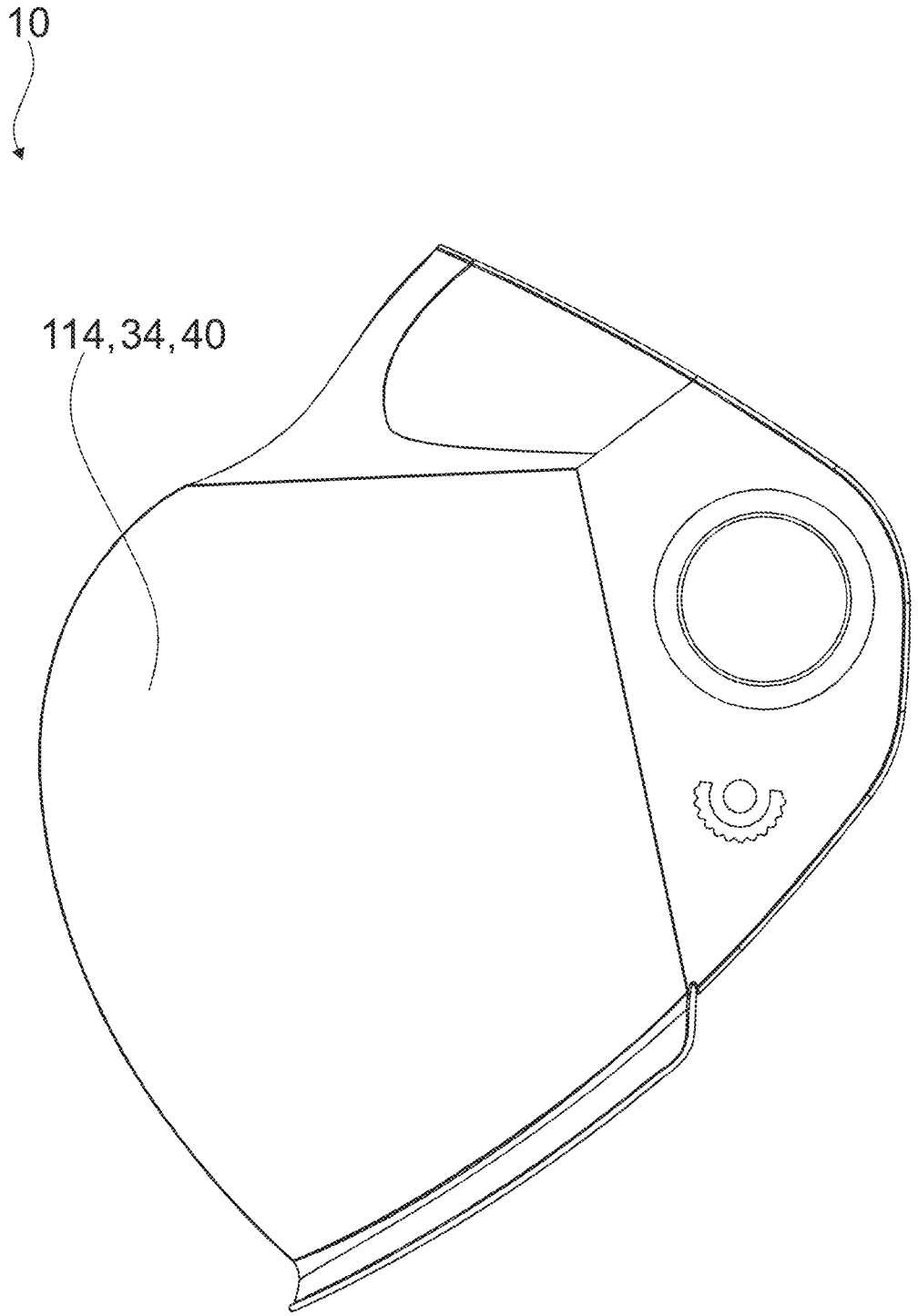
Figure 7:
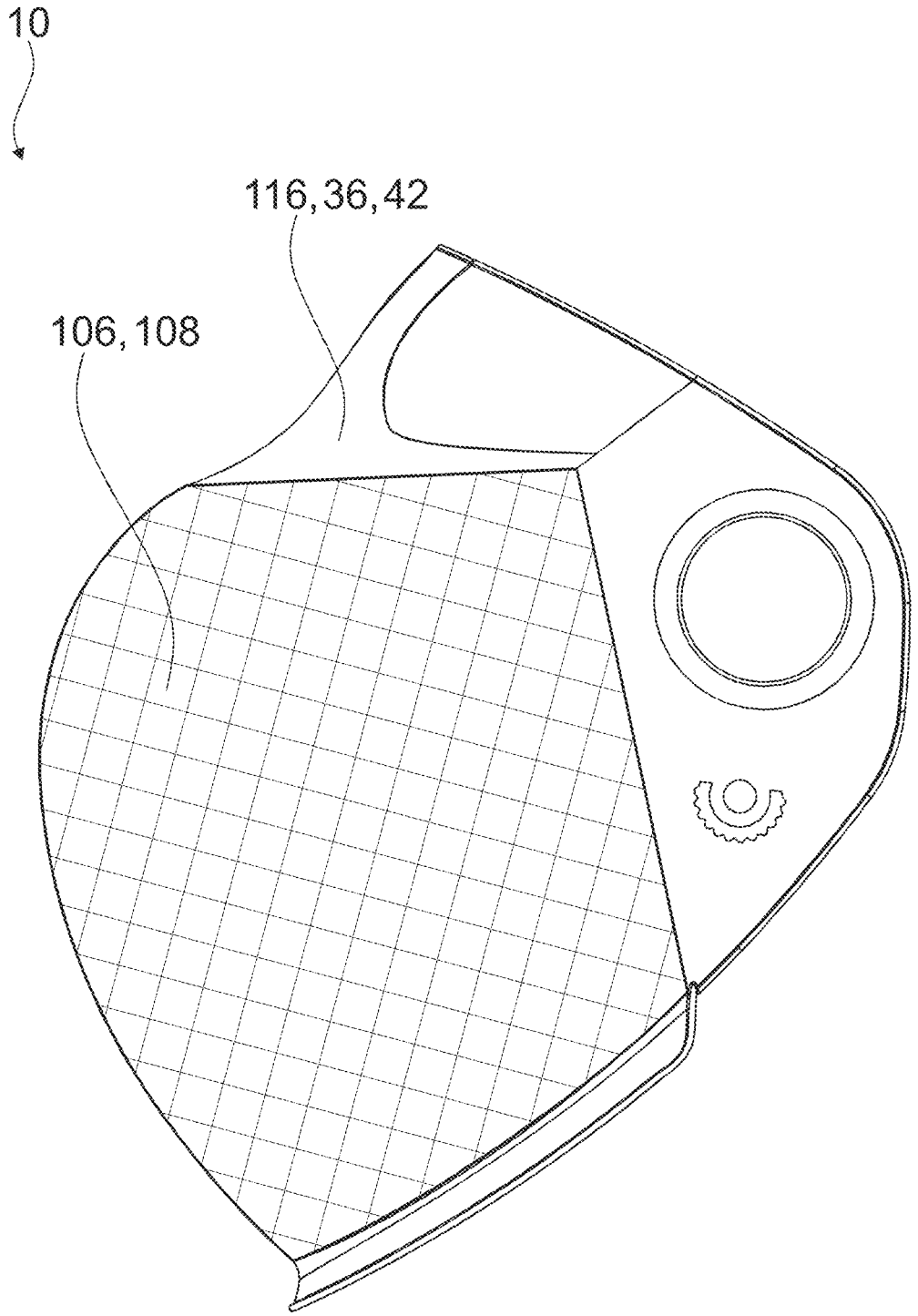
Figure 8:
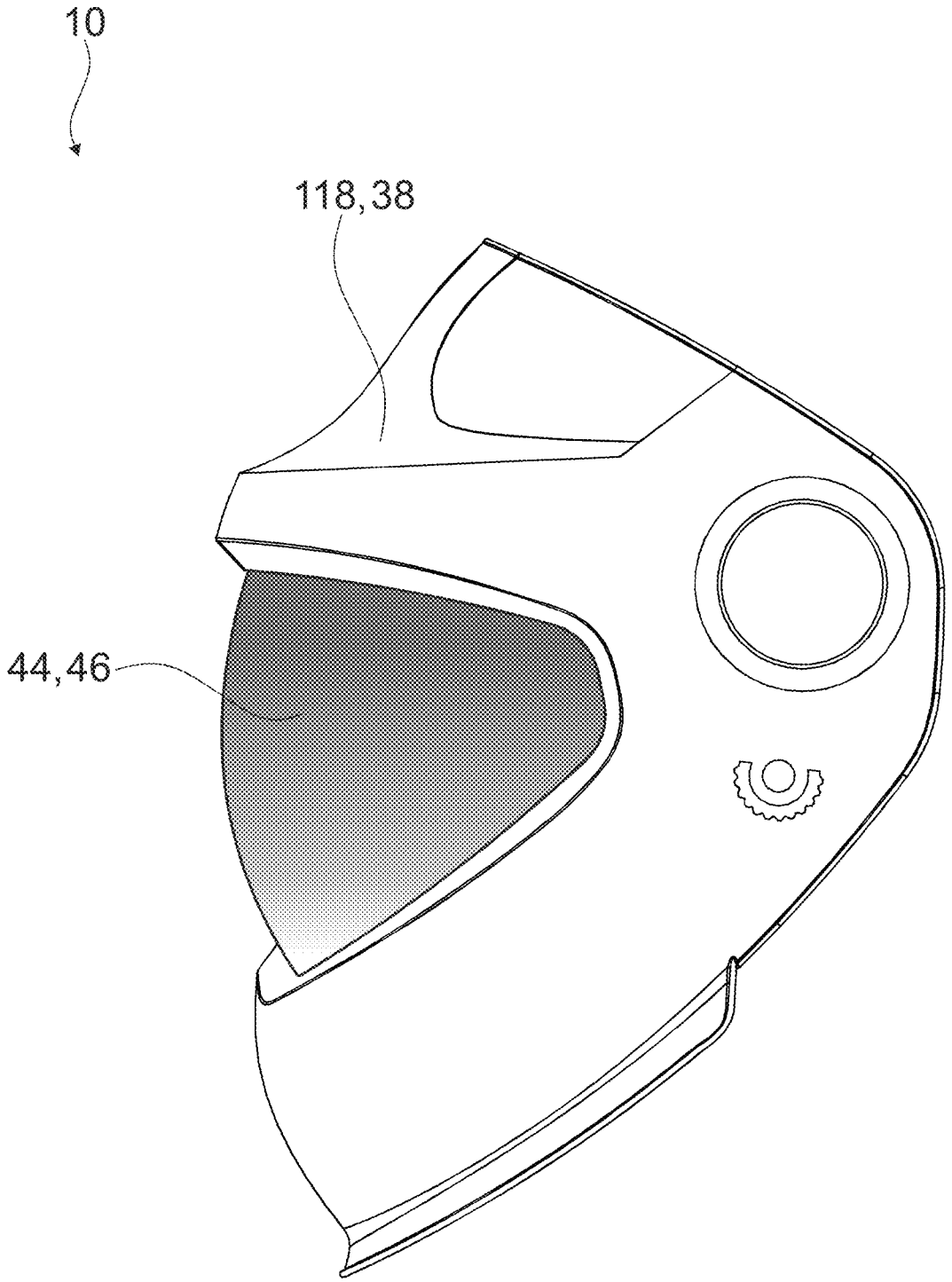

It is shown in:

FIG. 1 a protection device with a head-fastening unit, with a protection unit that is embodied as a shield unit, with a further protection unit that is embodied as a helmet shell and with a holding unit for a connection of the protection unit and the further protection unit to the head-fastening unit, in a schematic exploded perspective view, FIG. 2 a schematic side view of the exploded illustration of the protection device of FIG. 1, FIG. 3 a schematic top view of the exploded illustration of the protection device of FIG. 1, FIG. 4 the helmet shell, the head-fastening unit, the holding unit and a strap unit of the protection device, in a schematic exploded view from a front side, FIG. 5 a schematic side view and a schematic top view of the helmet shell, FIG. 6 a schematic illustration of a further shield unit of the protection device, which is embodied as a clear-view visor, FIG. 7 a schematic illustration of a further shield unit of the protection device, which is embodied as a lumberjack's visor, and FIG. 8 a schematic illustration of a further shield unit of the protection device, which comprises a further protection element that is embodied as a sun protection element.

DESCRIPTION OF THE EXEMPLARY EMBODIMENT

FIG. 1 shows a protection device 10 in a schematic exploded view. The protection device 10 comprises a head-fastening unit 12. The head-fastening unit 12 is configured for fastening the protection device 10 to a user's head (not shown). The head-fastening unit 12 comprises a tensioning element 98 and several tensioning webs 100. By means of the tensioning element 98 of the head-fastening unit 12, the tensioning webs 100 can be tensioned to different extents for the purpose of adapting the dimension of the head-fastening unit 12 to the size of a user's head, thus enabling a firm hold of the head-fastening unit 12 on the user's head.

The protection device 10 comprises a protection unit 110 for a protection of the user. In the present case the protection unit 110 is embodied as a shield unit 14. The shield unit 14 comprises at least one protection element 16 for a protection of the user. In the present case the shield unit 14 is realized as a welding protection visor 30. The protection element 16 of the shield unit 14 comprises an optical glare protection filter 32. The protection device 10 furthermore comprises a sensor unit (not shown). The sensor unit is configured to detect a work state and, depending on the work state, for an actuation of a transmittance of the optical glare protection filter 32. The sensor unit comprises at least one sensor (not shown), which is configured to detect a welding process or an occurrence of a bright light, which may damage a user's eyes or may affect a user's eyes otherwise. The sensor of the sensor unit is embodied as a photocell. However, principally a different implementation of the sensor of the sensor unit, deemed expedient by someone skilled in the art, would also be conceivable.

The protection device 10 comprises a holding unit 18. The holding unit 18 is configured for connecting the protection unit 110 to the head-fastening unit 12. The holding unit 18 directly contacts the at least one protection unit 110, the helmet shell 20 and the head-fastening unit 12 and is directly connected to the head-fastening unit 12. The holding unit 18 comprises a first receiving element 54 and a second receiving element 56. The first receiving element 54 and the second receiving element 56 are realized mirror-symmetrically to each other. The holding unit 18 further comprises a first holding element 58 and a second holding element 60. The holding unit 18 comprises a first fastening element 62 and a further first fastening element 64, which are fixedly connected with the head-fastening unit 12.

The holding unit 18 is implemented at least partially integrally with the head-fastening unit 12. In the present case the first fastening elements 62, 64 of the holding unit 18 are in each case implemented integrally with the head-fastening unit 12. The first fastening elements 62, 64 are arranged on a lefthand side of the head-fastening unit 12 and are configured for a fastening of the first holding element 58 to the head-fastening unit 12. The head-fastening unit 12 further comprises two second fastening elements (not shown), which are implemented substantially identically to the first fastening elements 62, 64, which are arranged opposite the first fastening elements 62, 64 on a righthand side of the head-fastening unit 12 and which are also implemented integrally with the head-fastening unit 12. The second fastening elements are configured for a fastening of the second holding element 60 to the head-fastening unit 12. The first holding element 58 and the second holding element 60 in each case have several latch recesses 66, which are arranged horizontally side by side. The first receiving element 54 and the second receiving element 56 in each case have two latch tabs 68, which engage in respectively two of the latch recesses 66 in the respective holding elements 58, 60 for creating a latch connection.

The shield element 14 has a first receiving opening 70 and a second receiving opening 72. The first receiving opening 70 is arranged on a lefthand side of the shield unit 14. The second receiving opening 72 is arranged on a righthand side of the shield unit 14, opposite the first receiving opening 70. For a connection of the shield unit 14 to the head-fastening unit 12 via the holding unit 18, the first receiving element 54 engages into the first receiving opening 70 and the second receiving element 56 engages into the second receiving opening 72. In a connected state the shield unit 14 is connected with the head-fastening unit 12 in a rotationally movable manner via the receiving elements 54, 56 of the holding unit 18. The shield unit 14 comprises a fixing unit 74. The fixing unit 74 comprises two gear rings 78, which are in each case arranged radially around the first receiving opening 70 and the second receiving opening 72. The fixing unit 74 comprises at least two fixing elements 76, which are capable of engaging into the teeth of the gear rings 78. By means of the fixing elements 76, the shield unit 14 can be fixed in at least two different positions relative to the head-fastening unit 12. The fixing unit 74 comprises at least two adjusting elements 80 for an actuation of the fixing elements 76 and for fixing the shield unit 14 in the relative positions to the head-fastening unit 12. In a first relative position the shield unit 14 is oriented at least substantially perpendicularly to the head-fastening unit 12 in order to cover the face of the user of the protection device 10, for example during welding work. In a second relative position the shield unit 14 is oriented at least substantially parallel to the head-fastening unit 12, for example so as to allow the user of the protection device 10 a free field of vision during interruptions of the welding work. By means of the fixing unit 74, the shield unit 14 can be fixed in the first relative position, in the second relative position and in further relative intermediate positions between the first relative position and the second relative position.

Furthermore, a horizontal distance between the shield unit 14 and the head-fastening unit 12 is adjustable in that, depending on requirements, the latch tabs 68 of the first receiving element 54 and the second receiving element 56 can be latched in the respective holding elements 58, 60 in different ones of the latch recesses 66 which are arranged horizontally side by side.

The protection device 10 further comprises a further protection unit 112. The holding unit 18 is configured for connecting the further protection unit 112 to the head-fastening unit 12. The holding unit 18 is configured to connect the protection unit 110 and the further protection unit 112 with the head-fastening unit 12 at the same time. In the present exemplary embodiment, the further protection unit 112 is embodied as a helmet shell 20, namely a construction worker's helmet shell. The helmet shell 20 is configured to absorb an impact energy at least to a large extent. The helmet shell 20 is connectable to the head-fastening unit 12 via the holding unit 18. For a connection to the head-fastening unit 12, the helmet shell 20 has two receiving recesses 82, 84. A first receiving recess 82 of the helmet shell 20 is arranged on a lefthand side of the helmet shell 20. For a connection of the helmet shell 20 to the head-fastening unit 12 via the holding unit 18, the first receiving element 54 engages into the first receiving recess 82 and latches with said first receiving recess 82. A second receiving recess 84 of the helmet shell 20 (cf. FIG. 3) is arranged opposite the first receiving recess 82 on a righthand side of the helmet shell 20. For a connection of the helmet shell 20 to the head-fastening unit 12 via the holding unit 18, the second receiving element 56 correspondingly engages into the second receiving recess 84 and latches with said receiving recess 84.

The holding unit 18 comprises a height adjusting unit 24 for an adjustment of a distance between the helmet shell 20 and the head-fastening unit 12. For this purpose, several latch pins 86 of the height adjusting unit 24 are arranged vertically above one another on the respective rear sides of the holding elements 58, 60 of the holding unit 18. The height adjusting unit 24 further comprises several latch openings 88, which are arranged vertically above one another in the first fastening elements 62, 64 and in the second fastening elements. For an adjustment of the distance between the helmet shell 20 and the head-fastening unit 12, the latch pins 86 of the height adjusting unit 24 can be plugged accordingly into different ones of the latch openings 88 which are arranged vertically above one another.

FIG. 2 shows a schematic side view of the exploded perspective view of the protection device 10 of FIG. 1.

The protection device 10 comprises a strap unit 26. The strap unit 26 is arrangeable between the helmet shell 20 and the head-fastening unit 12 and is configured for partially receiving an impact energy. The strap unit 26 comprises a chin strap holder 28. The chin strap holder 28 is configured for a fastening of a chin strap (not shown). The chin strap holder 28 comprises a first chin strap holder element 90 and a second chin strap holder element 92. When the strap unit 26 is arranged between the helmet shell 20 and the head-fastening unit 12, the first chin strap holder element 90 is situated on the lefthand side of the head-fastening unit 12 and the second chin strap holder element 92 is situated on the righthand side of the head-fastening unit 12. The chin strap holder 28 may, for example, be hooked into the first chin strap holder element 90, tensioned across the user's chin and then hooked into the second chin strap holder element 92.

FIG. 3 shows a schematic top view of the exploded perspective illustration of the protection device 10 of FIG. 1.

The helmet shell 20 comprises a forehead recess 22. The shield unit 14 is configured to cover the forehead recess 22 independently from a set position relative to the headfastening unit 12. In the first relative position between the shield unit 14 and the head-fastening unit 12, in which the shield unit 14 is oriented at least substantially perpendicularly to the head-fastening unit 12, an upper region 94 of the shield unit 14 covers the forehead recess 22 of the helmet shell 20. In the second relative position between the shield unit 14 and the head-fastening unit 12, in which the shield unit 14 is oriented at least substantially parallel to the head-fastening unit 12, a lower region 96 (see FIG. 1) covers the forehead recess 22 of the helmet shell 20.

FIG. 4 shows the helmet shell 20, the head-fastening unit 12, the holding unit 18 and the strap unit 26 of the protection device 10 in a schematic exploded view from a front side.

FIG. 5 shows two schematic illustrations of the helmet shell 20. An upper illustration of FIG. 5 shows a schematic side view of the helmet shell 20 in a state when it is connected with the head-fastening unit 12 via the holding unit 18. A lower illustration of FIG. 5 shows the helmet shell 20 in a schematic top view.

The helmet shell 20 comprises a ventilation unit 48. The ventilation unit 48 comprises at least one ventilation opening 50. In the present case the ventilation unit 48 comprises the ventilation opening 50 and a further ventilation opening 102. The ventilation unit 48 further comprises at least one cover element 52, which is configured to cover the ventilation opening 50 at least partially. The ventilation unit 48 moreover comprises a further cover element 104, which is configured to cover the further ventilation opening 102 at least partially.

The protection device 10 comprises at least one additional protection unit 114. In the present case the protection device 10 comprises the additional protection unit 114 (see FIG. 6), a further additional protection unit 116 (see FIG. 7) and a further additional protection unit 118 (see FIG. 8). The additional protection units 114, 116, 118 are in each case implemented as different further shield units 34, 36, 38, which are in each case exchangeable with the protection unit 110 that is embodied as a shield unit 14.

FIG. 6 shows a schematic view of the additional protection unit 114, which is implemented as a further shield unit 34. The further shield unit 34 is embodied as a clear-view visor 40.

FIG. 7 shows a schematic view of the further additional protection unit 116, which is implemented as a further shield unit 36. The further shield unit 36 is embodied as a lumberjack visor 42. A further protection element 106 of the further shield unit 36 which is embodied as a lumberjack visor 42 is implemented as a protective mesh 108.

FIG. 8 shows a schematic view of the further additional protection unit 118, which is implemented as a further shield unit 38. Differently than the shield unit 14, the further shield unit 38 comprises a further protection element 44. The further protection element 44 is embodied as a sun protection element 46. The sun protection element 46 comprises a UV filter (not shown).

The invention claimed is:

1. A protection device comprising:

a head-fastening unit for fastening to a user's head, at least one protection unit, a helmet shell, and a holding unit that at the same time connects the at least one protection unit and the helmet shell to the head-fastening unit;

wherein the holding unit directly contacts the at least one protection unit, the helmet shell and the head-fastening unit, and is directly connected to the head-fastening unit, and comprises a first receiving element and a second receiving element, wherein for a connection of the protection unit to the head-fastening unit, the first receiving element is engaged with a first receiving opening of the protection unit and the second receiving element is engaged with a second receiving opening of the protection unit that is arranged opposite the first receiving opening, wherein for a connection to the head-fastening unit, the helmet shell has two receiving recesses, wherein for a connection of the helmet shell to the headfastening unit via the holding unit, the first receiving element engages into the first receiving recess and the second receiving element correspondingly engages into the second receiving recess.

2. The protection device according to claim 1, comprising the protection unit, which is embodied as a shield unit with at least one protection element.

3. The protection device according to claim 2, wherein the shield unit is configured to cover a forehead recess of the helmet shell independently from a set position relative to the head-fastening unit.

4. The protection device according to claim 2, wherein the shield unit is embodied as a welding protection visor.

5. The protection device according to claim 4, wherein the protection element of the shield unit comprises an optical glare protection filter.

6. The protection device according to claim 2, comprising a further shield unit and which is exchangeable with the shield unit.

7. The protection device according to claim 6, wherein the further shield unit is embodied as a clear-view visor.

8. The protection device according to claim 6, wherein the further shield unit is embodied as a lumberjack visor.

9. The protection device according to claim 6, wherein the further shield unit comprises a sun protection element.

10. The protection device according to claim 1, wherein the helmet shell is realized as a construction worker's helmet shell.

11. The protection device according to claim 10, wherein the helmet shell has a forehead recess.

12. The protection device according to claim 10, wherein the holding unit comprises a height adjusting unit for an adjustment of a distance between the construction worker's helmet shell and the head-fastening unit.

13. The protection device according to claim 10, comprising a strap unit, which is arrangeable between the helmet shell and the head-fastening unit and is configured for a force transmission from the construction worker's helmet shell to the user's head.

14. The protection device according to claim 13, wherein the strap unit comprises a chin strap holder.

15. The protection device according to claim 10, wherein the helmet shell comprises a ventilation unit with at least one ventilation opening.

16. The protection device according to claim 15, wherein the ventilation unit comprises at least one cover element, which is configured to cover the ventilation opening at least partially.

17. The protection device according to claim 1, wherein the holding unit is implemented at least partially integrally with the head-fastening unit.

18. The protection device according to claim 1, wherein the helmet shell is intended to be worn over the head fastening unit, and further wherein a main extension plane of the at least one protection unit is oriented at least substantially perpendicularly to a main extension plane of the head-fastening unit when in a first position.

* * * * *